United States Patent [19]

LaGattuta

[11] Patent Number: 4,920,644

[45] Date of Patent: May 1, 1990

[54] DISPOSABLE STRAIGHT RAZOR AND/OR BLADE HOLDER THEREFOR

[76] Inventor: Milton LaGattuta, 61 Kings Point Rd., East Hampton, N.Y. 11937

[21] Appl. No.: 330,687

[22] Filed: Mar. 30, 1989

[51] Int. Cl.[5] ..... B26B 21/00; B26B 21/08; B26B 1/00; B26B 1/04

[52] U.S. Cl. ..... 30/53; 30/50; 30/338; 30/330

[58] Field of Search ..... 30/53, 54, 55, 77, 85, 30/329, 330, 337, 338, 32, 50

[56] References Cited

U.S. PATENT DOCUMENTS

| | | | |
|---|---|---|---|
| 1,407,638 | 2/1922 | Collins | 30/330 |
| 1,847,765 | 3/1932 | Kinsley | 30/50 |
| 2,192,362 | 3/1940 | Merlo | 30/53 |
| 3,255,523 | 6/1966 | Robertson et al. | 30/53 |
| 3,308,533 | 3/1967 | Holohan | 30/338 |
| 3,383,763 | 5/1968 | Strandfors | 30/53 |
| 4,285,125 | 8/1981 | Chen et al. | 30/53 |
| 4,622,742 | 11/1986 | Lee | 30/55 |
| 4,665,615 | 5/1987 | Martinez | 30/53 |

*Primary Examiner*—Douglas D. Watts
*Assistant Examiner*—Paul M. Heyrana Sr.
*Attorney, Agent, or Firm*—Michael I. Kroll

[57] ABSTRACT

The straight razor has a handle portion and a pivotable blade holder with a razor blade permanently and rigidly attached to the handle portion. The handle portion and the blade holder are made of economical easily used materials so that the straight razor is at least partially disposable. In one embodiment the blade holder is pivotally permanently mounted on a connecting pin joining two opposing parallel handle panels of the handle and the entire straight razor is disposable, while in another embodiment the shank portion of the blade holder has a recess in which the connecting pin is engagable so that only the blade holder and razor blade are disposable.

4 Claims, 2 Drawing Sheets

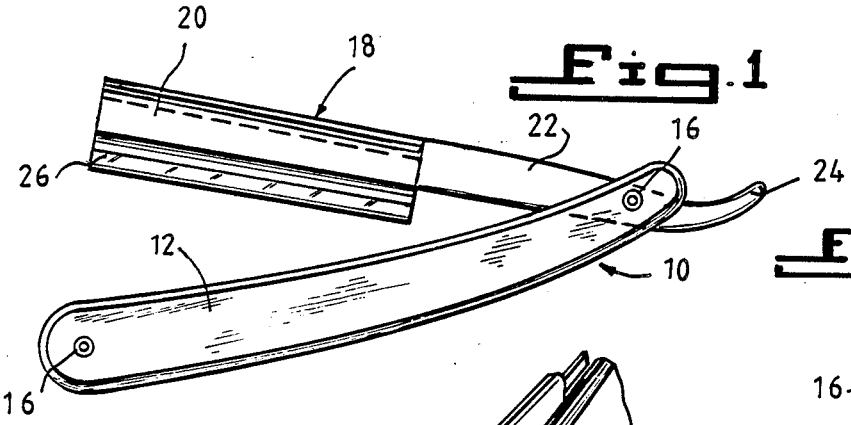
Fig. 1
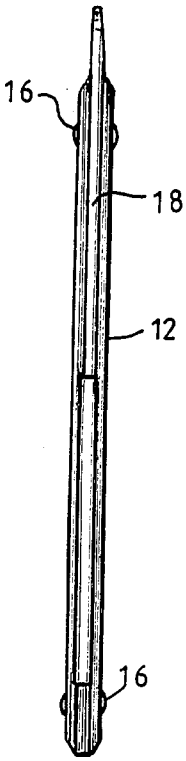
Fig. 2
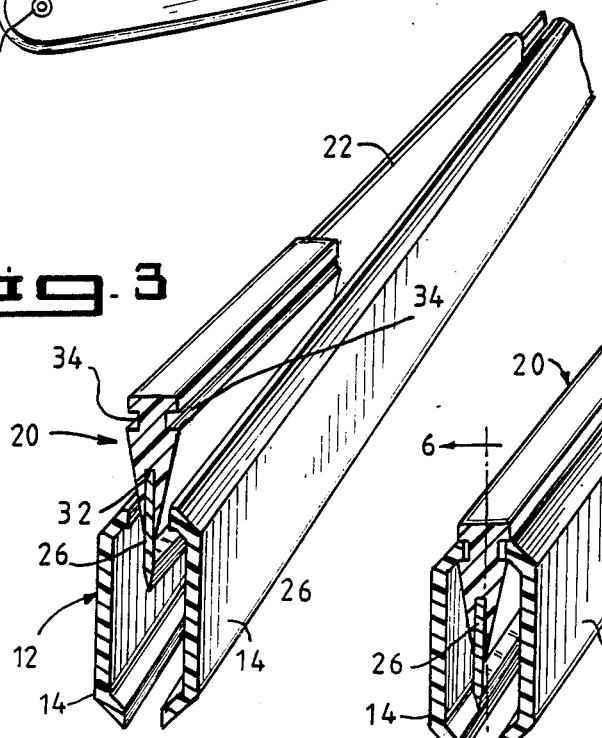
Fig. 3
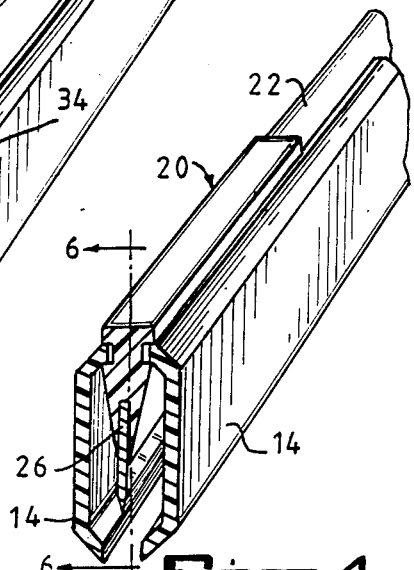
Fig. 4
Fig. 5
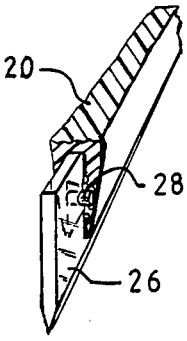
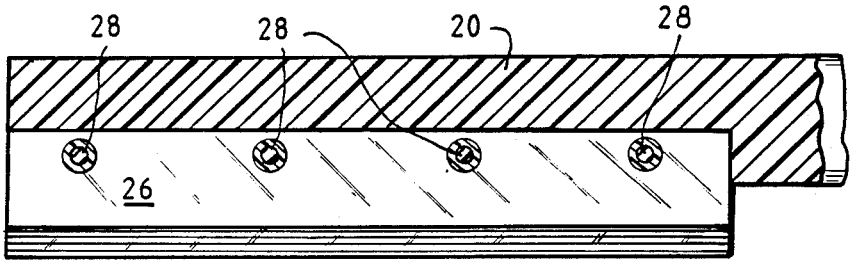
Fig. 6

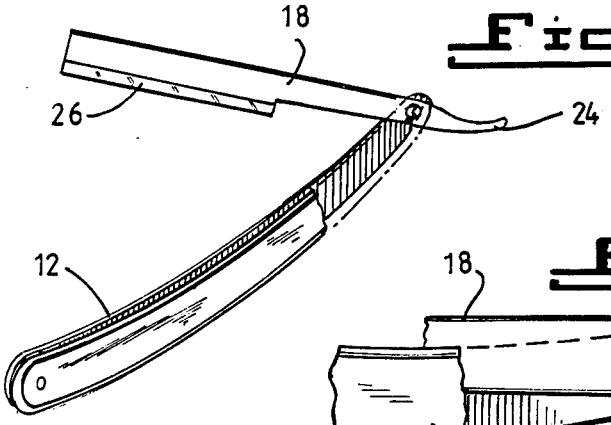
Fig. 7
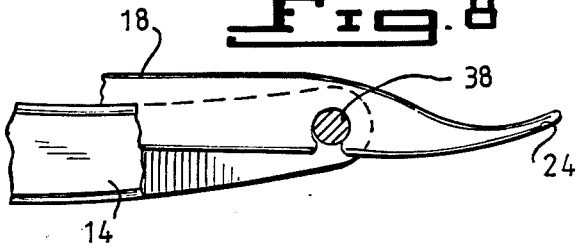
Fig. 8
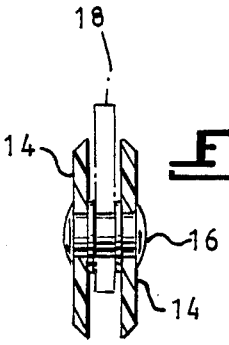
Fig. 9
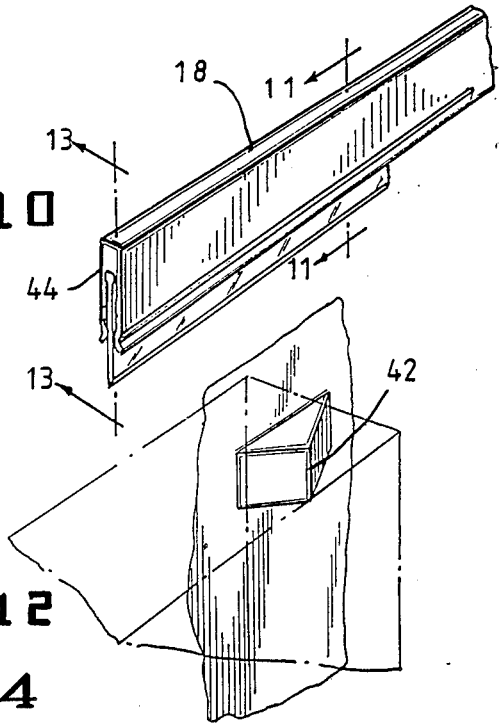
Fig. 10
Fig. 11
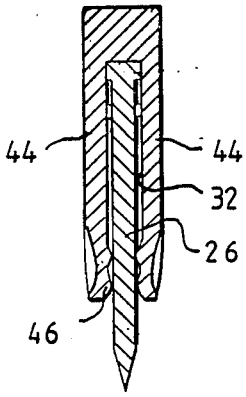
Fig. 12
Fig. 13
Fig. 14
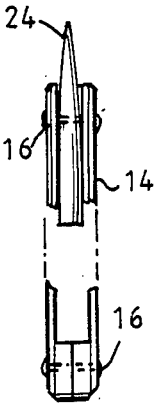
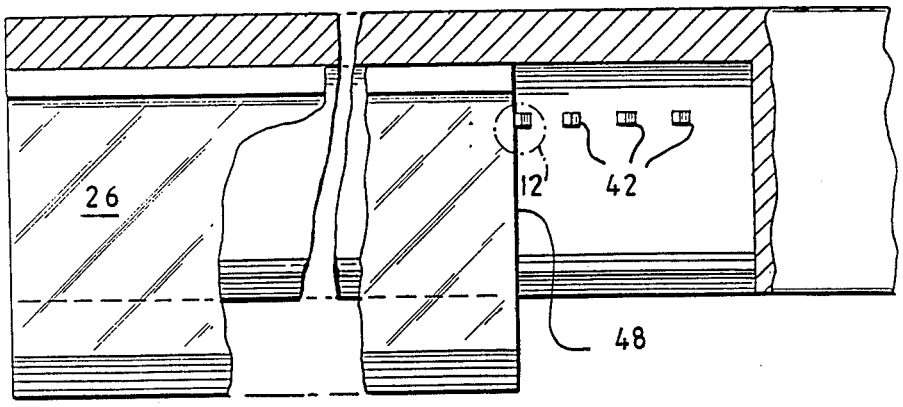

DISPOSABLE STRAIGHT RAZOR AND/OR BLADE HOLDER THEREFOR

THE FIELD OF THE INVENTION

The invention relates to a straight razor of the kind used by barbers to shave their customers.

THE BACKGROUND OF THE INVENTION

By "straight razor" we mean a razor blade-carrying device comprising a handle portion, a blade holder portion one end of which is pivotally attached adjacent to one end of the handle and a razor blade which is held by or attached to the blade holder by a variety of means. The handle may have a blade-receiving recess located so that the razor blade, when not in use, may be completely covered by folding the blade holder toward the handle protecting persons and property from being inadvertently cut.

The straight razor is to be distinguished form a common shaving razor which is used by an individual to shave himself which comprises a blade holder with a handle and separately sold razor blades which are inserted in or mounted on the blade holder. Recently a very advantageous modification of this common shaving razor has been marketed in which the blade holder, the handle and the razor blade are a single unit which is made of plastic with the exception of the razor blade. This shaving razor is disposable and cheap.

The straight razor in contrast to the common shaving razor is used primarily by barbers in barber shops to remove side burns and hair from necks to obtain a very close shave. The barber often sharpens the blade immediately before using it on a particular customer. This type of razor then is used on a number of different individuals. Disadvantageously it either transfers germs, tissue and blood residue from individual to individual or it must be carefully cleaned between uses. This is especially a problem now because of the current concern with various infectious blood diseases. When the straight razor has a guard and a plurality of other parts this is even more difficult.

Straight razors of the type described above date back to a time before the turn of the century.

A straight razor having a separate blade holder for a razor blade in which the razor blade engages slidably is described in U.S. Pat. No. 871,037. Various straight razors with guards for the blade have been described including ones in U.S. Pat. Nos. 854,540; 1,262,073; 1,088,183; 933,317; and 3,646,672. Often however these guards contribute additional parts to he razor which provide more locations for dirt and germs to collect making the straight razor more difficult to clean.

It is an object of this invention to provide an improved straight razor which is entirely or in part inexpensive and disposable.

It is also an object of the present invention to provide an improved straight razor which eliminates the time required to clean it between customers and/or does not communicate germs and/or dirt between customers in a barber shop.

It is another object of the present invention to provide an improved straight razor which may be disposed easily but, when disposed, does not cause injury.

SUMMARY OF THE INVENTION

According to the present invention the straight razor has a handle portion and a pivotable blade holder with a razor blade pivotally attached to the handle portion. The handle portion and the blade holder are made of economical easily used materials so that the straight razor is at least partially disposable. In one embodiment the blade holder is pivotally permanently mounted on a connecting pin joining two opposing parallel handle panels of the handle and the entire straight razor is disposable, while in another embodiment the shank portion of the blade holder has a recess in which the connecting pin is engageable so that only the blade holder and razor blade are disposable.

The blade holder and the handle may be made of any of a variety of inexpensive materials such as plastic materials, metal and wood.

The blade holder may comprise a holder portion with a central longitudinal slot in which the razor blade is slidably mounted and a connected shank portion with a rearward-directed finger for manipulation. The razor blade may be rigidly attached to the holder portion by a plurality of studs and/or bonding agents. Alternatively it can be tensionally held in a holder portion with deformable side walls and pressing lips which has a longitudinal slot which is laterally smaller than the razor blade. Then the heel of the blade may rest on any of a number of projections on the interior of the side walls.

The handle portion may comprise two similarly shaped substantially parallel handle panels attached to each other with connecting pins one of which is a pivot for the blade holder. The upper edges of the handle panels may be inwardly directed and may be deformable so that they can engage in longitudinal grooves in opposite sides of the holder portion. In this case then, when the straight razor is thrown away, the blade holder can be pressed toward the handle until the blade holder is locked in the handle with the upper edges of the handle panels engaged in the longitudinal grooves. Individuals handling the disposed straight razor are thus protected from injury.

DETAILED DESCRIPTION OF THE DRAWING FIGURES

FIG. 1 is a side elevational view of one embodiment of a disposable straight razor according to the invention.

FIG. 2 is top plan view of the disposable straight razor shown in FIG. 1. FIG. 3 is a partially perspective, partially cross sectional view of the straight razor of FIG. 1 showing structural details in the vicinity of the blade.

FIG. 4 is a partially perspective, partially cross sectional view of the straight razor of FIG. 1 similar to FIG. 3.

FIG. 5 is a perspective view showing details of the straight razor of FIG. 1 in the vicinity of the razor blade.

FIG. 6 is a cross sectional view of a straight razor showing details of attachment of the razor blade taken along the section line 6—6.

FIG. 7 is a perspective view of another embodiment of a straight razor according to the present invention.

FIG. 8 is a partially cutaway side view of the rear portion of the straight razor of FIG. 7 showing how the shank of the blade holder is attached to the handle.

FIG. 9 is a rear elevational view of the straight razor of FIG. 7 showing further details.

FIG. 10 is a perspective view of the blade holder for the razor blade used in the straight razor of FIG. 7.

FIG. 11 is a cross sectional view of the blade holder and razor blade of FIG. 10 taken along the section line 11—11.

FIG. 12 is a perspective view showing how the razor blade is held in the blade holder.

FIG. 13 is a side elevational view of the razor blade mounted in the blade holder.

FIG. 14 is a top plan view of a straight razor according to our invention showing structural details of the handle panels.

DETAILED DESCRIPTION OF THE INVENTION

One embodiment of a disposable straight razor according to the present invention is shown in FIGS. 1 to 6. FIGS. 7 to 9 show a variant, i.e. another embodiment, in which the blade holder and razor blade but not the handle are disposable. FIGS. 10 to 13 show details of construction of the blade holder and razor blade.

The completely disposable razor blade 10 of FIGS. 1 to 6 comprises a handle 12 having two handle panels 14 of a similar longitudinally-extended shape attached together with connecting pins 16 adjacent opposite ends of the handle 12, a blade holder 18 having a holder portion 20 and a shank portion 22 with a rearward-directed finger 24 for opening and closing the straight razor and a razor blade 26 rigidly attached by studs 28 in the holder portion 20. The handle panels 14, the holder portion 20 and the shank portion 22 must be made of an inexpensive deformable material such as plastic or wood so that disposal of the razor is economical after its use. The handle connecting pins 16 are made of a low cost easily obtainable material such as steel or iron.

The handle panels 14 have upper and lower inwardly-directed longitudinal edges 30',30 and are deformable. The opposing upper longitudinal edges 30' and lower longitudinal edges 30 are parallel with each other. The razor blade 26 is held in a longitudinal slot 32 in the center of the approximately triangular cross-sectioned holder portion 20. The top portion of the blade holder 18 has twin parallel longitudinally extending grooves 34 adjacent the top of the blade holder 18. The holder portion 20 is rigidly attached to the shank portion 22.

As shown in FIG. 6 the razor blade 26 is held in the longitudinal slot by the studs 28 which are engaged in the material of the holder portion 20. The handle connecting pins 16 connect the handle panels 14 rigidly to each other similarly but the shank portion 22 which passes through the opposing handle panels is pivotally mounted on the rear connecting pin 16 which passes through a hole in it.

In operation the finger may be used to manipulate the straight razor open or closed. FIG. 3 and 4 show the disposable straight razor being closed. The blade holder 18 is pivoted on the rear connecting pin 16 and the holder portion 20 is pressed between the handle panels 14. This may be continued until the upper inwardly-directed edges 30' are outwardly deformed and engage in the opposing parallel grooves 34. Then the straight razor 10 is locked with the handle completely covering the razor blade as shown in FIG. 4 and may be disposed after it is used on a single customer without threatening to injure because of an exposed blade.

Another embodiment of the straight razor 10 is shown in FIGS. 7 to 10. The same economical materials and general construction methods are used. Similar parts are numbered with the same referenced number. The primary difference between this and the preceding embodiment is the manner in which the shank portion is pivotally connected to the handle. Here the shank portion 22 has a recess 38 in the edge which is nearly circular in cross section (about 90 degrees of arc are removed from the circle). The shank portion 22 is made of a deformable plastic material. Thus the recess 38 is easily engaged on the connecting pin 16 which is of a diameter such that the shank portion 22 will not readily disconnect or fall off the connecting pin 16 after the connecting pin has been snapped into the recess by deforming the edges of the recess. Then the razor blade 26 in the blade holder 18 may be pivoted and manipulated without falling from the handle. However the shank portion 20 may be easily removed from the connecting pin 16 so that the blade holder 18 and the razor blade 26 may be disposed after use. In this embodiment then the handle need not be disposed but only the razor blade 26 and the blade holder 18.

FIGS. 10 to 13 show an alternative way of holding the razor blade 26 in the holder portion 20. In this embodiment the longitudinal slot 34 has projections 42 placed at varying intervals along its interior wall. The heel 48 of the razor blade 26 then rests on these projections 42 while it is held under tension by the side walls 44 of the holder portion 20 which must be deformed for insertion of the razor blade 26 in the slot 34. The razor blade 26 is then held primarily by the pressing lips 46.

There are a variety of ways to maintain the handle panel spacing at the end of the straight razor 10 at which the shank portion 22 is pivotally attached where that spacing is maintained by the intervening shank portion 22. A washer or spacer may be used as in the embodiment shown in FIG. 2. An alternative is shown in FIG. 16. In this case the handle panels 16 are thickened at the end of the handle to which the shank portion of the blade holder is not pivotally attached. In this way the spacing between the handle panels is maintained at this end of the handle as well.

LIST OF REFERENCE PARTS 10 straight razor(the invention)
12 handle
14 handle panel
16 connecting pin
18 blade holder
20 holder portion
22 shank portion
24 rearward-directed finger
26 razor blade
28 studs
30 lower inwardly-directed edges(on handle panel)
30' upper inwardly-directed edges
32 longitudinal slot
34 longitudinally-extending groove
38 recess(in shank portion)
42 projections
44 side wall
46 pressing lip
48 heel It will be understood that each of the elements described above, or two or more together, may also find a useful application in other devices differing from the type of device described above.

The invention is not intended to be limited to the details provided above and it will be understood that various omissions, modifications, substitutions, and changes in the forms and details of the device illustrated and in its operation can be made by those skilled in the art without departing in any way from the spirit of the present invention.

Without further analysis, the foregoing will so fully reveal the gist of the present invention that others can, by applying current knowledge readily adapt it for various applications without omitting features that, from the standpoint of the prior art, fairly constitute essential characteristics of the generic or specific aspects of this invention.

What is claimed is new and what is to be protected by Letters Patent is:

1. An economical simply-constructed straight razor which is at least in part disposable comprising a handle, a blade holder having a holder portion and a shank portion connected to said holder portion, said shank portion being pivotally mounted on said handle at an end of said shank portion opposite said holder portion and a razor blade forming a heel mounted in said holder portion, said blade holder and said handle being made of inexpensive, easily-used materials, said handle being made of two substantially parallel similar shaped handle panels connected by two connecting pins, said shank portion being pivotally mounted on one of said connecting pins, said shank portion being deformable and having a nearly circular-cross sectioned recess located in a side facing said handle which is engageable with said connecting pin so that said blade holder with said razor blade is replaceable or disposable, said holder portion having a longitudinal groove having deformable side walls, said side walls of said holder portion having a plurality of projections for holding a heel of said razor blade, said longitudinal groove being laterally smaller than said razor blade and said side walls having opposing pressing lips so that said razor blade is tensionally held when slid in said longitudinal groove with said pressing lips.

2. A straight razor as defined in claim 1 in which said handle portion and said blade holder are made of plastic materials.

3. A straight razor as defined in claim 1 in which said handle portion is made of wood and said blade holder is made of a plastic material.

4. An economical simply-constructed straight razor which is at least in part disposable comprising a handle, a blade holder having a holder portion and a shank portion connected to said holder portion, said shank portion being permanently and pivotally mounted on said handle at an end of said shank portion by a connecting pin through a hole in said shank portion, a razor blade mounted in said holder portion, said blade holder and said handle being made of inexpensive, easily-used materials, said handle having handle panels that are deformable and said razor blade being slidably mounted on rigidly attached studs in a longitudinal slot centrally positioned in said holder portion and two opposing longitudinally-extending grooves are provided on the upper portion on opposite sides of said holder portion and the upper edges of said handle panels are inwardly-directed and formed so that said upper edges are engageable in said grooves when said blade holder is folded into said handle to prevent injury.

* * * * *